US008083573B2

(12) United States Patent
Barous

(10) Patent No.: US 8,083,573 B2
(45) Date of Patent: Dec. 27, 2011

(54) DUST COLLECTION AND CONTAINMENT IN A ROTARY FLOOR SANDING MACHINE

(75) Inventor: Francis A Barous, Dracut, MA (US)

(73) Assignee: Essex Silverline Corporation, Dracut, MA (US)

( * ) Notice: Subject to any disclaimer, the term of this patent is extended or adjusted under 35 U.S.C. 154(b) by 671 days.

(21) Appl. No.: 12/263,581

(22) Filed: Nov. 3, 2008

(65) Prior Publication Data

US 2009/0124182 A1 May 14, 2009

Related U.S. Application Data

(60) Provisional application No. 60/987,183, filed on Nov. 12, 2007.

(51) Int. Cl.
*B24B 23/02* (2006.01)
*B24B 55/10* (2006.01)

(52) U.S. Cl. ..... 451/359; 451/360; 451/353; 451/456

(58) Field of Classification Search ..... 451/359, 451/360, 353, 357, 457, 456, 451, 345
See application file for complete search history.

(56) References Cited

U.S. PATENT DOCUMENTS 5,105,585 A * 4/1992 Hampl et al. ..... 451/359
5,237,781 A * 8/1993 Demetrius ..... 451/456
D352,439 S 11/1994 Bedford
5,609,516 A * 3/1997 Courson et al. ..... 451/456
5,791,979 A * 8/1998 Duncan et al. ..... 451/456
5,890,954 A 4/1999 Barous
6,425,813 B1 7/2002 Ernst
6,616,518 B2 * 9/2003 Sun et al. ..... 451/456
6,752,707 B1 6/2004 Palushi
6,827,640 B2 12/2004 Bures et al.
6,921,320 B1 7/2005 Nielson et al.
7,118,468 B2 10/2006 Robichaud et al.
7,128,640 B2 10/2006 Barous
7,162,771 B2 1/2007 Grosze et al.
7,222,392 B2 5/2007 McCormick et al.
7,381,117 B2 6/2008 Barous
7,942,727 B2 * 5/2011 Kodaverdian et al. ..... 451/350

* cited by examiner

*Primary Examiner* — Dung Van Nguyen

(74) *Attorney, Agent, or Firm* — Vern Maine & Associates

(57) ABSTRACT

A rotary floor sanding machine has a vertically oriented bell housing with a backside floor support and a dust suction port for removing dust from within. The bell housing encloses the sides and backside of a disk casing and rotary sanding pad. The floor support is configured to place the floor contact area of the sanding pad forward of center. There is a lifting vane extending from proximate the floor contact area of the sanding pad in the direction of rotation towards the suction port in the bell housing to elevate dust particles to the higher velocity airflow near the suction port. There may be a shield for reducing the floor level opening between the back edge of the disk casing and the bell housing.

20 Claims, 5 Drawing Sheets

DUST COLLECTION AND CONTAINMENT IN A ROTARY FLOOR SANDING MACHINE

RELATED APPLICATIONS

This application claims the benefit of U.S. Provisional Application No. 60/987,183, filed Nov. 12, 2007, and is herein incorporated by reference in its entirety.

FIELD OF THE INVENTION

The invention relates to powered, rotating disk surface conditioning tools. More particularly, it relates to rotary floor edgers and sanders with dust collection systems.

BACKGROUND OF THE INVENTION

Referring to FIG. 1, a floor edger is an electrically powered, handheld, rotary floor sanding tool. It has a motor housing which houses an electric motor and fan. A pair of handholds are attached on opposing sides of motor housing. A power cord and dust bag are likewise attached to the motor housing at other than the front side.

Referring to prior art FIGS. 1 and 2, the bell housing is a circular metal skirt firmly attached to the lower end of the motor housing, enclosing rotor head to which is attached a disk casing and a sanding pad or disk. The sanding disk and casing protrude very slightly below and out in front of the bell housing along the front edge to enable contact of the disk with the floor and use of the edger up close to baseboards and other obstructions on the floor. Rotation of the sanding disc from the top view is clockwise. The bell housing forms a skirt-like enclosure around the disc casing and a plenum over it, to which suction is applied by an internal suction fan for removing the dust generating by the abrading of the floor materials during sanding operations. The dust is pulled in through the floor level opening between bell housing and the casing, and is collected in an attached bag or routed to an external dust collection system.

The float bar and/or caster assembly is secured to the back side of the bell housing and configured for height adjustment. The purpose of a float bar assembly, and/or casters in the alternative, is twofold. The primary purpose is to tilt the axis of the sander slightly forward, so that the forward portion of the sanding pad, indicated by the shaded area A, is in contact with the floor. This is necessary in order to maintain positive control of the machine motion and control over its sanding performance. The second purpose is to provide a smooth, sliding contact surface of sufficient surface area to support of the weight of the machine on the back edge of the bell housing without creating or causing an indentation in the floor surface when the weight is being continuously shifted by operator skill between the sanding pad and the float bar assembly, during gliding movement of the machine over the floor surface while sanding.

As is apparent in FIG. 2, which is a top view of the floor level section or bottom of the machine, the rear and in particular the right side of the bell housing has a slightly bulbous extension of its skirt or lower edge, providing somewhat more radial clearance from the disc casing and enclosed sanding disk than on the left side. The intent was to provide a larger cross section area floor level opening for receiving the relatively greater amount of discharge of dust from beneath the sanding pad coming off its forward area of contact with the floor during clockwise rotation.

Dust collection and containment is extremely important to floor edgers and sanders in order to keep floor and wall as clean as possible, avoiding the introduction of that loose particulate matter between the sanding pad and the floor, and increasingly, for improving operator respiratory and vision environmental factors as well.

SUMMARY OF THE INVENTION

The invention, in its simplest form, is an improvement to the design of a floor edger/sander, and other similarly configured surface conditioning tools, for more efficient and effective dust collection and containment.

In one aspect of the invention there is an improvement to a floor edger with a motorized circular sanding disk, bell housing and back side casters and/or a float bar assembly for providing back side support of the machine so as to place the working edge of the circular sanding disk forward towards the front edge of the bell housing, and equipped with an internal suction fan that applies suction through a suction port in the bell housing for removing dust created by sanding operations. The improvement relates to improving the dust collection and containment but is enabled by a combination of modifications of mechanical elements and structures. The dust includes particulate matter removed from the floor surface by the abrading action of the rotating sanding pad, for example but not limited to materials such as hardwood and the fluids and coatings that may have been applied to it.

In another aspect, the back edge float bar includes a mounting bracket and a float bar. The mounting bracket is configured to mate closely and securely in a horizontal orientation with, and is attached by conventional hardware to, the rear lower edge of the bell housing. The float bar is rotatable over a limited range of motion around its single point of attachment to the mounting bracket, and may be secured at a desired small angle off the horizontal, for the purposes explained below.

This range of adjustment provides for tilting the machine slightly to the left or right of vertical, and more significantly, for tilting the already forward angle or bias provided by the float bar assembly to the axis of rotation of the edger, slightly to the right or left. This tilting of the float bar assembly results in moving or rotating the effective area of contact of the sanding disk or pad with the floor, clockwise or counterclockwise a few degrees from purely forward, corresponding to the adjustment of the float bar. Rotating the right side (as viewed from the rear) of the float bar assembly downward so as to tilt the machine to the left, moves the floor contact area of the sanding pad to the left, and vice versa. In operation, only the sanding pad and the float bar contact the floor, and in particular, only an angular segment or pie slice portion of the sanding pad surface. The center or eye of the pad, up to the first ⅓ of the sanding pad radius, may in some embodiments be recessed and not be able to contact the floor.

Another embodiment of the invention provides a shield or panel disposed at the rear of the bell housing to close off a portion of the gap between the disc casing within which is contained the disc and sanding pad, and the bell housing. This reduction in the size or cross section area of this opening tends to increase the velocity and effectiveness of the dust collection suction force through the remainder of the opening. This shield may be attached to the bell housing or to the disc casing or both. It will be positioned such that it does not contact the floor.

Yet another embodiment of the invention provides a lifting vane disposed within the bell housing between the disc casing and the bell housing in the perimeter air flow path between the floor and the vacuum or suction port in the bell housing. The lower end is located closer to floor level and proximate the down stream edge of the right side opening defined by the bulbous portion of the bell housing. The length of the lifting vane extends around the inside perimeter of the bell housing to the backside suction port location, at a relatively uniform lifting angle such that the upper end is proximate the suction port in the bell housing.

It will be appreciated by those skilled in the art that much of the dust removed by the clockwise-rotating sanding pad is cast off generally in the direction of the open area on the right side of the bell housing. The suction of the vacuum system applied through the plenum of the bell housing and disk casing to the floor level opening is intended to pick up dust from everywhere within the bell housing. It has been discovered that by proper alignment of the contact area of the sanding disk with the floor, and by reduction of the opening around other sides of the bell housing, that the airflow tends to be greater through the larger right side of the floor level opening. Acceleration of dust by rotation of the sanding pad causes it to tend to follow the right side curvature of the bell housing in a circular path until defused within the plenum. A lifting vane, properly placed in the localized airflow and extending upwards to the proximity of the suction port, acts as a circular ramp to lift or force the heavier than air dust particles delivered by the sanding pad to that location, circularly upward and close to the suction port where the higher velocity of the suction air near the port is able to support and accelerate the dust particles vertically into the suction mechanism and downstream collection system, which may be onboard or remote to the sander.

The lifting vane or ramp may have a smooth surface, in particular a smooth upper surface, which may be planar or may be trough-shaped or have an outboard upward extending shoulder or flange along its circular path or length. In some embodiments it may be semi or fully enclosed for all or a portion of its length. Its effective cross section area of airflow transport may be constant or may decrease going from bottom to top. Its rate of incline from bottom to top may be constant or it may be varied such as having an increasing angle of incline going from bottom to top. It may be attached at points or continuously along an edge or otherwise to the disc casing or the bell housing or both.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The invention is susceptible of many embodiments. For example, in one embodiment there is an improvement to a floor edger with a motorized circular sanding disk, bell housing and back side casters and/or a float bar assembly for providing back side support of the machine so as to place the working edge of the circular sanding disk forward towards the front edge of the bell housing, and equipped with or piped to a suction fan or blower that applies suction through a suction port in the bell housing for removing dust created by sanding operations. The improvement relates to improving the dust collection and containment but is enabled by a combination of modifications of mechanical elements and structures as are described below.

Figure 1:
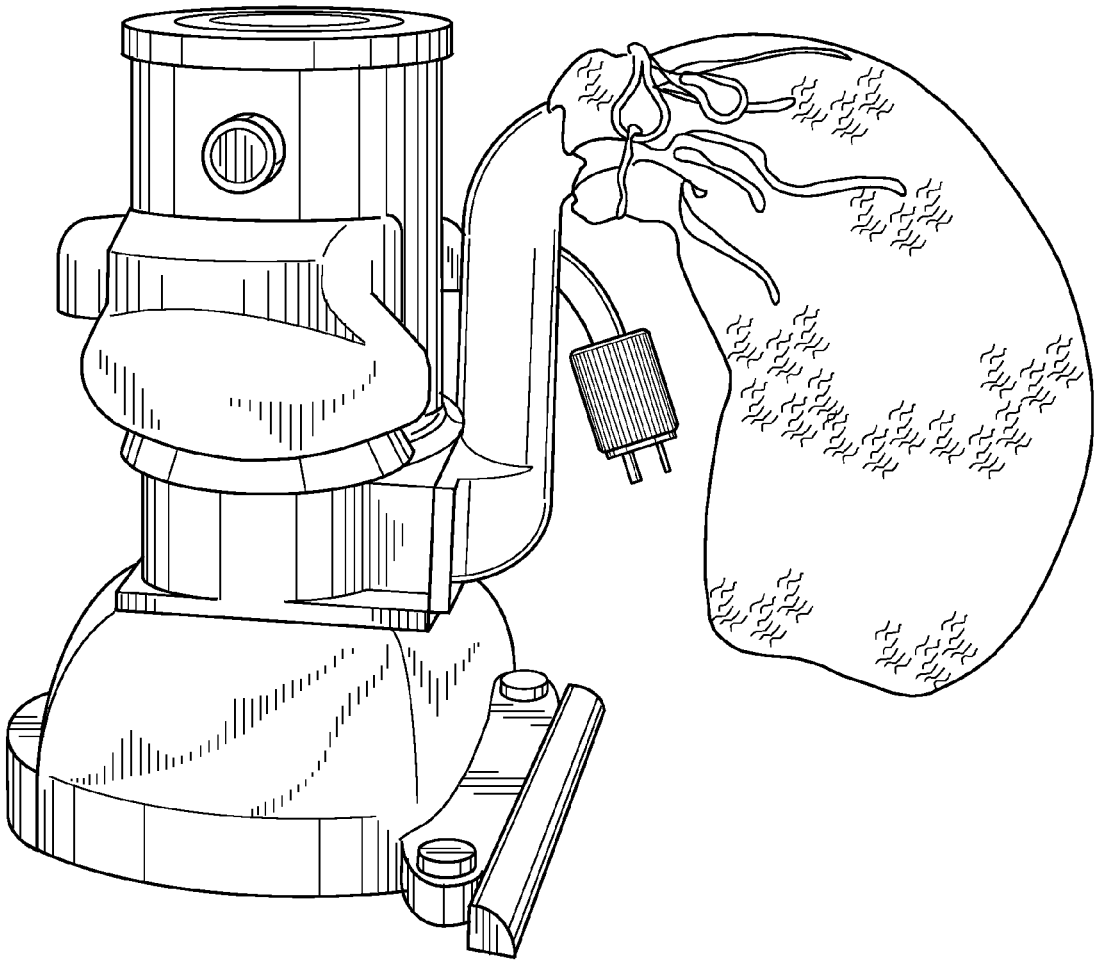
FIG. 1 (PRIOR ART)
FIG. 1 is an upper left side perspective view of an edger floor sanding machine of the prior art.
Figure 2:
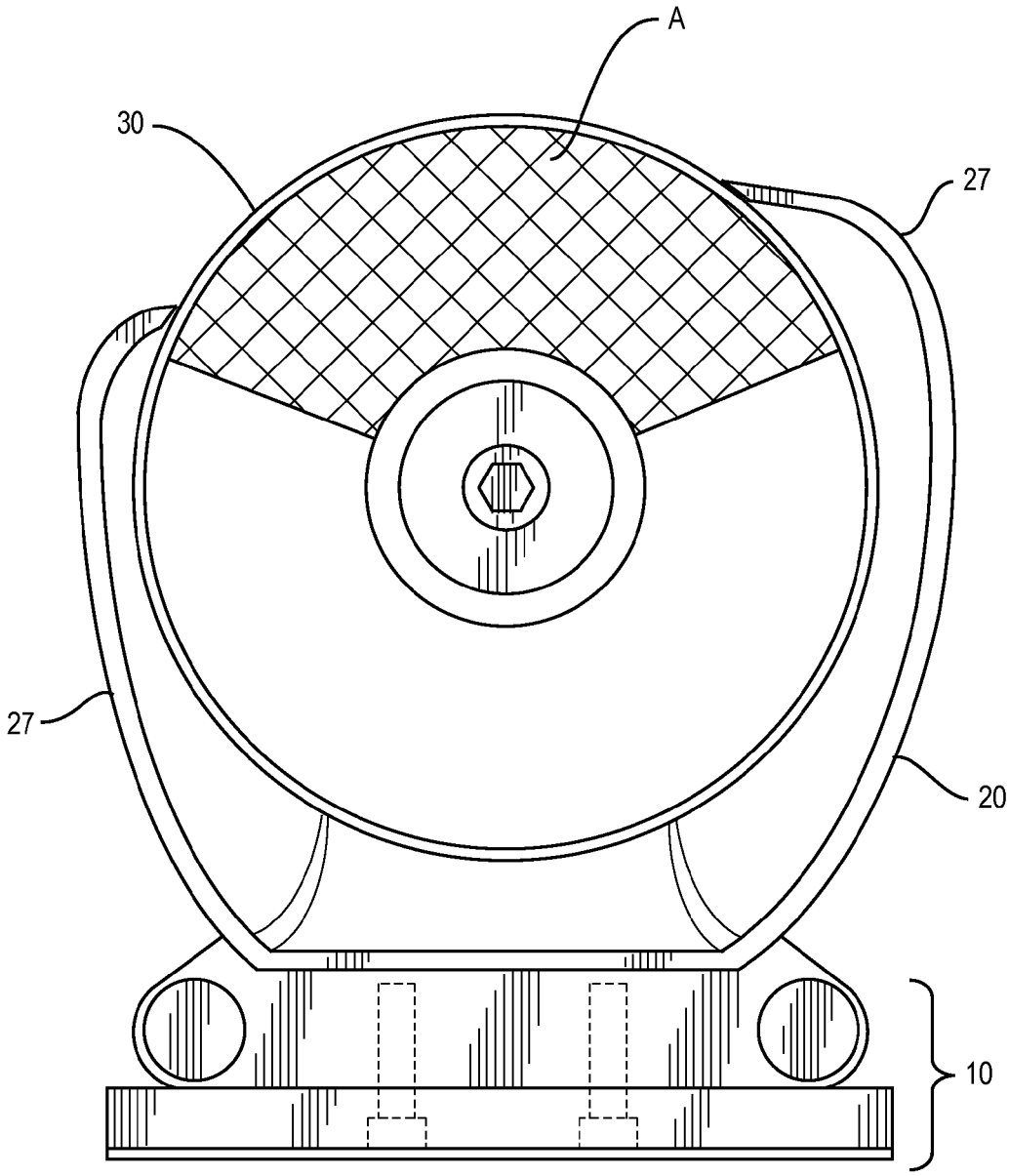
FIG. 2 is a top view of the floor level section of the embodiment of FIG. 1, wherein disk rotation is clockwise and back edge support is configured to maintain a floor contact area at the forward side of the disk area.
Figure 3:
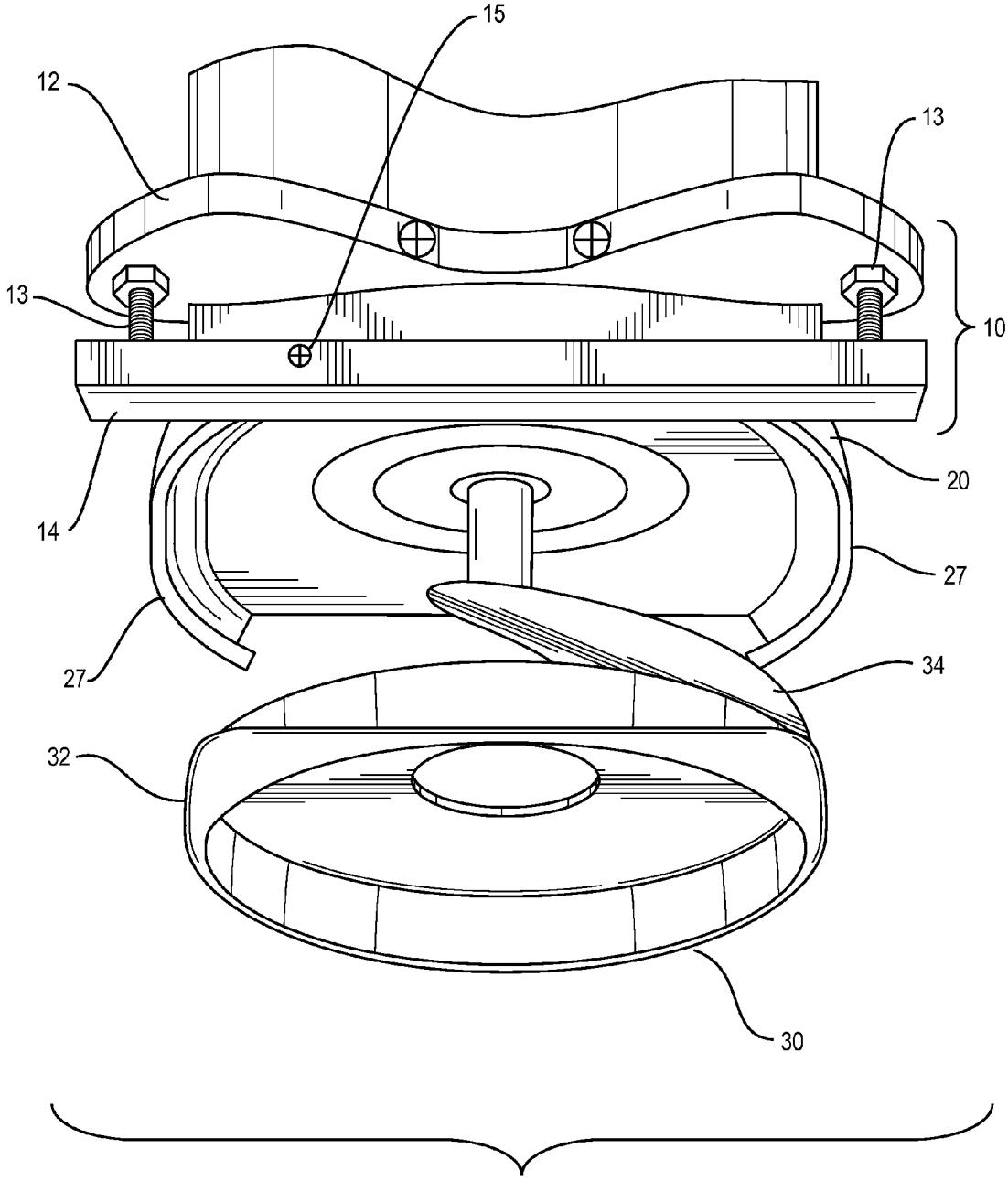
FIG. 3 is a lower back side perspective, exploded view of the lower end of a floor edger machine, configured with a modified float bar assembly, and with the sanding disk removed and a modified disk casing shown separated from the bell housing to reveal details.
Figure 5:
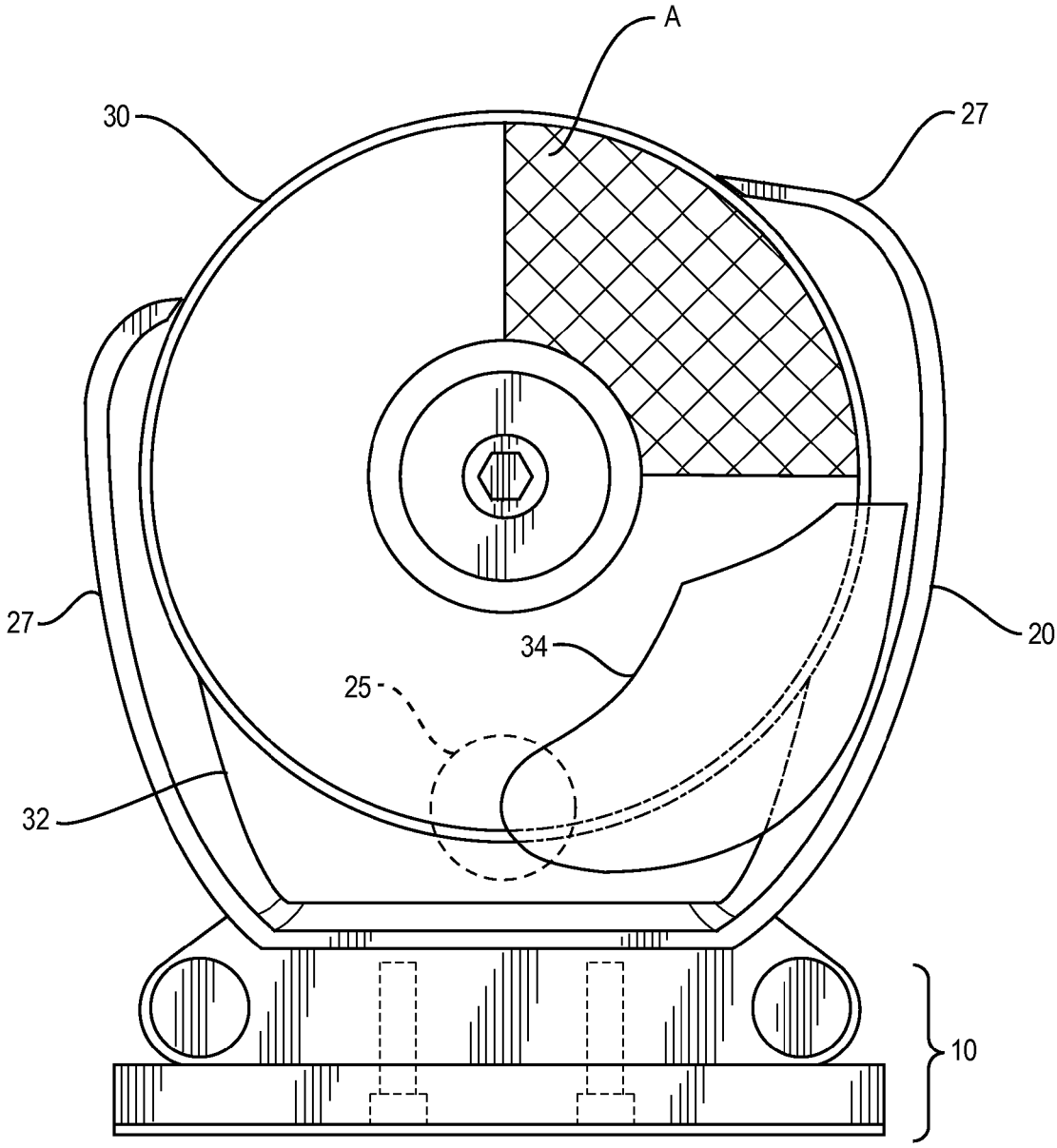
FIG. 5 is a top view of the floor level section of an embodiment of the invention where a modified disk casing is revealed, disk rotation is clockwise and back edge support is configured to maintain a floor contact area at the forward-right quadrant of the disk area.

Referring to FIGS. 3 and 5, the back edge float bar assembly 10 includes a tilt adjust bracket 12, tilt adjusting screws 13 and a float bar 14. The tilt adjust bracket is attached by conventional hardware to the back side of the bell housing 20. The float bar is attached to the bell housing below the tilt adjust bracket at a single point 15 about which it is rotatable over a limited range of motion and may be secured at a desired small angle off the horizontal by securing screws 13 from further rotation, for the purposes explained below.

The float bar is attached to the bell housing so as to assure that there is a forward bias or tilt of the machine axis so that the floor contact area of a sanding pad will be along the forward edge, as in the prior art. However, the range of tilt adjustment feature provides for tilting the machine slightly to the left or right of vertical, and more significantly, for tilting the already forward angle or bias provided by the float bar assembly to the axis of rotation of the edger, slightly to the right or left. As illustrated in FIG. 5, this tilting of the float bar assembly results in moving or rotating the effective area of contact of the sanding disk or pad with the floor, clockwise or counterclockwise a few degrees from purely forward, corresponding to the adjustment of the float bar. Rotating the left side (as viewed from the rear) of the float bar assembly downward so as to tilt the machine to the right, moves the floor contact area of the sanding pad to the right to area A as shown. When the height and tilt adjustment is correct, a significant portion of the abbrated material will be made available at the right side opening for a localized suction mechanism or feature to collect and contain.

Other embodiments may be equipped with a castor assembly or one or more rolling points of floor contact in addition to or in the alternative to the aforementioned float bar assembly.

Figure 4:
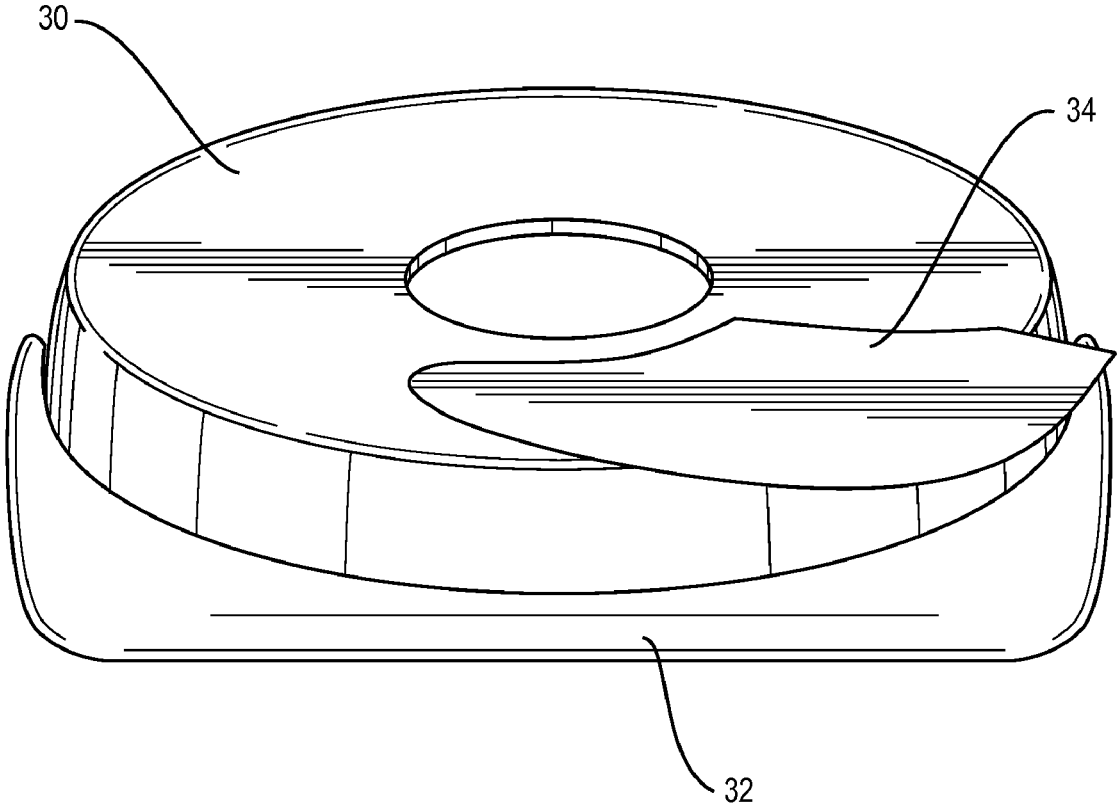
FIG. 4 is a perspective view of a disk casing modified to include a shield and a lifting vane.

Referring to FIGS. 3, 4 and 5, another embodiment of the invention provides a shield or panel 32 disposed at the rear of the bell housing to close off a portion of the gap or floor level opening between the disc casing 30 within which is contained the disc and sanding pad, and the bell housing 20. This reduction in the size or cross section area of this opening tends to increase the velocity and effectiveness of the dust collection suction force through the remainder of the opening. This shield may be attached to the bell housing 20 or as shown in FIG. 4, to the back edge of disc casing 30, or to both, but is configured so that it does not contact the floor directly.

Still referring to FIGS. 3, 4 and 5, yet another embodiment of the invention provides a lifting vane 34 disposed within the bell housing between the disc casing 30 and the bell housing 20 in the perimeter air flow path between the floor and the vacuum or suction port 25 (shown in dotted line in FIG. 6) in the bell housing. The bottom or lower end is located closer to floor level and proximate the down stream edge of the right side opening defined by the bulbous portion of the bell housing 20. The length or path of the lifting vane 34 extends around the inside perimeter of the bell housing 20 proximate to the backside suction port 25 location, at a relatively uniform lifting angle such that the upper end is proximate the suction port. In other embodiments, the angle of inclination may vary over the length of the vane.

It will be appreciated by those skilled in the art that much of the dust removed by the clockwise-rotating sanding pad is cast off generally in the direction of the open area on the right side of the bell housing 20. The suction of the vacuum system applied through the plenum of the bell housing and disk casing to the floor level opening is intended to pick up dust from the full circumference of the sanding disk casing 30. Proper alignment of the contact area of the sanding disk with the floor by use of the tilting float bar mechanism 10, and by reduction of the opening around other sides of the disk casing with shield 32, tends to make the dust collection airflow greater through the larger right side of the floor level opening, whereafter it tends to follow the right side curvature of the bell housing in a circular path until defused within the plenum. However, lifting vane 34, configured in that localized airflow proximate the right side opening, acts as a ramp to lift or force the heavier than air dust particles delivered by the sanding pad to that location and localized circular air flow pattern, upward and closer to the suction port 25 in the bell housing 20. Here, the higher velocity of the suction air near the exit port 25 is able to support and accelerate the dust particles coming off the ramp, directing them into the suction mechanism.

The dust collection system is thus improved for more efficient capture of dust, including capture of the relatively high density discharge of heavier dust particles injected off the forward area contact section of the sanding pad into the bell housing at the bottom end by use of the vane while still providing a functional degree of airflow volume and velocity throughout the bell housing through the available openings between the bell housing and the disc casing to assure the collection of suspended dust accruing more generally throughout the volume enclosed between the bell housing and disc casing.

The lifting vane 34 may have a smooth surface which may be planar or may be trough-shaped over its length or have an outboard skirt or flange. It may in some embodiments be semi-enclose or fully enclosed over all or a portion of its length. It may be attached to the disc casing or the bell housing or both. The lower edge of the bell housing 20 may be configured with a soft skirt 27, a very compliant structure of soft material that acts to further close or reduce the space between the bell housing and the floor surface, reducing the leakage of air into the bell housing through other than the open front edge.

The invention is susceptible of many embodiments. For example, there is in one embodiment a rotary floor sander with a vertically oriented bell housing enclosing the sides and backside of a disk casing enclosing a rotable sanding disk to which a floor sanding pad is attachable. It has a floor support on a backside of the bell housing configured to limit floor contact area of the sanding disk to forward of center. The bell housing is thus supported just above the floor by the floor support and the sanding disk. There is a first mode of dust collection provided by a port in an upper region of the bell housing communicating with a vacuum source for extracting airborne dust from the bell housing by pulling air from between the floor and the lower edge of the bell housing.

There is a second mode of dust collection in this embodiment provided by a dust lifting vane disposed between the bell housing and the disk casing extending from near the floor contact area of the sanding disk, just outboard of the disk casing, upward in the direction of rotation towards the suction port in the bell housing. The vane is configured and aligned with the sanding disk so as to catch or receive dust particles expelled with a velocity imparted by the rotary sanding action of the floor sander from beneath the sanding disk, and direct these dust particles upward in the direction of rotation towards the suction port where they can be picked up by the higher velocity airflow within the upper region of the bell housing close to the suction port.

There may in some examples be a shield disposed between the back edge of the disk casing and the lower edge of the bell housing, configured so as to reduce the total floor level opening between the bell housing and the disk casing. There may be a flexible skirt material extending from the edge of the bell housing towards the floor so as to reduce the opening between the bell housing and the floor along selected areas of the periphery of the bell housing. In this or other examples the vane may be attached to at least one of or both the bell housing and the disk casing, by fasteners, adhesives, welding, or otherwise. The lifting vane may terminate at its upper end near the suction port in the upper end of the bell housing so that it is in relatively higher velocity airflow that can support heavier dust particles. The shield and/or the vane being welded or otherwise attached to disk casing for ease of fabrication and to be removable with the disk casing for service and repairs. Alternatively, either or both may be attached to the bell housing for retention when the disk casing is removed. The lifting vane in some examples may be configured with an outboard edge or rail or side for accelerating the dust particles in the normal direction of rotational of the sanding disk, which could be clockwise or counterclockwise. The floor support may be adjustable for height and for biasing the floor contact area of the sanding disk in the direction of rotation.

The invention is susceptible of compound methods for collecting and containing dust when using a rotary floor sander with a vertically oriented bell housing enclosing a disk casing and rotable sanding disk. For example, a first mode is providing a suction port in the bell housing communicating with a dust collection and containment system whereby airborne dust within the bell housing is drawn by airflow from beneath the periphery of the bell housing into the suction port. A second mode is providing a dust lifting vane disposed between the bell housing and the disk casing extending from proximate the floor contact area of the sanding disk upward in the direction of rotation towards the suction port in the bell housing, where the vane is configured and aligned with the sanding disk so as to receive dust particles expelled by rotary sanding action from beneath the sanding disk and direct the dust particles upward in the direction of rotation into the higher velocity airflow near the suction port.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A rotary floor sander comprising a vertically oriented bell housing enclosing the sides and backside of a disk casing enclosing a rotable sanding disk to which a floor sanding pad is attachable;

a floor support on a backside of the bell housing configured to limit floor contact area of the sanding disk to forward of center, the bell housing being thus supported just above the floor by the floor support and the sanding disk;

a port in an upper region of the bell housing communicating with a vacuum source for extracting dust from the bell housing by pulling air from between the floor and the lower edge of the bell housing; and a dust lifting vane disposed between the bell housing and the disk casing extending from proximate the floor contact area of the sanding disk upward in the direction of rotation towards the suction port in the bell housing, said vane being configured and aligned with said sanding disk so as to receive dust particles expelled by rotary sanding action from beneath the sanding disk and direct the dust particles upward in the direction of rotation towards the suction port.

2. The floor sander of claim 1, further comprising a shield disposed between the back edge of the disk casing and the lower edge of the bell housing, configured so as to reduce the total floor level opening between the bell housing and the disk casing.

3. The floor sander of claim 2, the shield being attached to at least one of the bell housing and the disk casing.

4. The floor sander of claim 2, the shield and the vane being welded to the disk casing.

5. The floor sander of claim 2, the shield being welded to the disk casing.

6. The floor sander of claim 2, the shield being attached to the bell housing.

7. The floor sander of claim 1, further comprising a flexible skirt material extending from the edge of the bell housing towards the floor so as to reduce the opening between the bell housing and the floor along selected areas of the periphery of the bell housing.

8. The floor sander of claim 1, the vane being attached to at least one of the bell housing and the disk casing.

9. The floor sander of claim 1, the vane terminating at an upper end proximate the suction port.

10. The floor sander of claim 1, said vane being welded to the disk casing.

11. The floor sander of claim 1, the vane configured with an outboard edge for accelerating the dust particles in the direction of rotational.

12. The floor sander of claim 1, the vane being attached to the interior wall of the bell housing.

13. The floor sander of claim 1, the floor support being adjustable for height and for biasing the floor contact area in the direction of rotation.

14. A rotary floor sander comprising:

a bell housing enclosing a substantial portion of a disk casing within which a sanding disk rotates;

a port in an upper region of the bell housing communicating with a vacuum source;

a floor support mechanism on a backside of the bell housing configured to limit floor contact area of the sanding disk to forward of center;

a shield welded to the lower backside edge of the disk casing and extending towards the lower edge of the bell housing, configured so as to reduce the floor level opening between the bell housing and the disk casing; and a dust lifting vane welded to the disk casing and enclosed by the bell housing, extending from adjacent the floor contact area of the sanding disk in the direction of rotation towards the suction port in the bell housing and configured so as to receive dust particles expelled by rotary sanding action from beneath the sanding disk and direct the dust particles upward in the direction of rotation towards the suction port.

15. A compound method for collecting and containing dust when using a rotary floor sander with a vertically oriented bell housing enclosing a disk casing and rotable sanding disk, comprising:

providing a suction port in the bell housing communicating with a dust collection and containment system whereby airborne dust within the bell housing is drawn by airflow from beneath the periphery of the bell housing into the suction port; and providing a dust lifting vane disposed between the bell housing and the disk casing extending from proximate the floor contact area of the sanding disk upward in the direction of rotation towards the suction port in the bell housing, said vane being configured and aligned with said sanding disk so as to receive dust particles expelled by rotary sanding action from beneath the sanding disk and direct the dust particles upward in the direction of rotation into higher velocity airflow near the suction port.

16. The method of claim 15, further comprising:

providing a shield disposed between the back edge of the disk casing and the lower edge of the bell housing, configured so as to reduce the total floor level opening between the bell housing and the disk casing.

17. The method of claim 16, the shield and the vane being welded to the disk casing so as to be removable with the disk casing.

18. The method of claim 15, the vane being welded to the disk casing so as to be removable with the disk casing.

19. The method of claim 15, the vane configured with an outboard edge for accelerating the dust particles in the direction of rotational.

20. The method of claim 15, the vane being attached to the interior wall of the bell housing for retention when the disk casing is removed.

* * * * *